US007399055B2

(12) United States Patent
Okamoto

(10) Patent No.: US 7,399,055 B2
(45) Date of Patent: Jul. 15, 2008

(54) INKJET PRINTER AND CAP UNIT FOR MAINTENANCE UNIT OF INKJET PRINTER

(75) Inventor: Tsugio Okamoto, Kani (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 310 days.

(21) Appl. No.: 10/809,365

(22) Filed: Mar. 26, 2004

(65) Prior Publication Data

US 2004/0189739 A1 Sep. 30, 2004

(30) Foreign Application Priority Data

Mar. 28, 2003 (JP) ..... 2003-092245

(51) Int. Cl.
*B41J 2/165* (2006.01)

(52) U.S. Cl. ..... 347/29; 347/31; 347/32

(58) Field of Classification Search ..... 347/22, 347/29, 30–33, 36, 90, 84, 89
See application file for complete search history.

(56) References Cited

U.S. PATENT DOCUMENTS

| | | | | |
|---|---|---|---|---|
| 4,383,263 | A * | 5/1983 | Ozawa et al. | 347/30 |
| 4,682,184 | A | 7/1987 | Terasawa | |
| 5,757,399 | A * | 5/1998 | Murayama et al. | 347/32 |
| 6,375,305 | B2 * | 4/2002 | Sugimoto et al. | 347/36 |
| 2004/0104961 | A1 | 6/2004 | Hashi et al. | |

FOREIGN PATENT DOCUMENTS

| | | |
|---|---|---|
| EP | 1 162 069 A2 | 12/2001 |
| JP | A 61-121950 | 6/1986 |
| JP | A 02-108553 | 4/1990 |
| JP | A 03-108556 | 5/1991 |
| JP | A 09-024618 | 1/1997 |
| JP | A 10-044471 | 2/1998 |
| JP | A 2001-030508 | 2/2001 |
| JP | A 2001-071521 | 3/2001 |
| JP | A 2001-301186 | 10/2001 |
| JP | A 2002-301831 | 10/2002 |
| JP | A 2002-355982 | 12/2002 |

OTHER PUBLICATIONS

Japanese Patent Application No. 2003-092245 Office Action issued Sep. 26, 2006.

* cited by examiner

*Primary Examiner*—Stephen D. Meier
*Assistant Examiner*—Geoffrey Mruk
(74) *Attorney, Agent, or Firm*—Oliff & Berridge, PLC

(57) ABSTRACT

In purge processing, ink ejected from a head weeps from a cap unit due to weight of the ink during the movement of a maintenance unit to a retraction position. Then, the ink is absorbed into a primary recovery portion mounted on a movable body. When the maintenance unit reaches the retraction position, the primary recovery portion comes into contact with an ink absorber of the secondary recovery portion so that the ink migrates from the primary recovery portion to the secondary recovery portion due to a capillary phenomenon. Also, when the maintenance unit moves to a maintenance position, the primary recovery portion comes into contact with an ink absorber of the secondary recovery portion so that the ink migrates from the primary recovery portion to the secondary recovery portion due to a capillary phenomenon.

9 Claims, 10 Drawing Sheets

INKJET PRINTER AND CAP UNIT FOR MAINTENANCE UNIT OF INKJET PRINTER

BACKGROUND OF THE INVENTION

1. Field of the Invention

The present invention relates to an inkjet printer and a cap unit for maintenance unit of the inkjet printer.

2. Description of the Related Art

In a head of an inkjet printer, a large number of nozzles are formed to eject ink there from so that printing can be carried out on recording paper or various sheet-like recording media (hereinafter also referred to collectively as "paper-like recording medium"). When ink is ejected through the nozzles, ink is supplied thereto. Therefore, the nozzles are always filled with ink.

When such a head is exposed to the atmosphere for a long time without carrying out printing, a solvent component evaporates gradually from the ink in the nozzles so that the ink in the nozzles may increase in concentration or the inside of each nozzle may be dried. In such a state, ink cannot be ejected properly from the nozzles. Thus, the quality of printing is deteriorated.

Therefore, the inkjet printer is provided with a cap, which comes into close contact with the head when the head does not engage in printing, in order to prevent the ink in the nozzles from increasing in concentration or the inside of each nozzle from being dried (for example, see JP-A-2001-301186 and JP-A-2002-301831).

Even though such a cap is provided, passage of a long time may result in evaporation of the solvent component from the ink so that the ink charged into the nozzles may increase in concentration. At a time of starting printing, processing for bringing the cap into close contact with the head while ejecting ink from the head to thereby eliminate high-concentration ink from the head (hereinafter also referred to as "purge processing") is therefore performed (see the paragraph [0010] in JP-A-2001-301186 and the paragraph [0035] in JP-A-2002-301831).

JP-A-2001-301186 and JP-A-2002-301831 disclose the following purge processing system. In the disclosed purge processing system, a negative pressure is generated in a cap by use of a suction pump so as to generate a difference in pressure between an ink flow channel on the upstream side of the head and the inside of the cap, by which ink is ejected from the head. In the following description, this purge processing system will be referred to as "suction system".

On the other hand, the present inventor has examined another purge processing system in which the pressure is increased in an ink flow channel on the upstream side of the head by use of a pressure pump so as to generate a different in pressure between the ink flow channel on the upstream side of the head and the inside of the cap, by which ink is ejected from the head. In the following description, this purge processing system will be referred to as "pressure system".

However, in a case of performing the purge processing in the pressure system, there has been a problem as will described below.

In the case of the suction-system purge processing, ink ejected from the head is sucked by the suction pump so that the ink can be discharged to the outside of the cap. Accordingly, waste ink in the cap can be eliminated comparatively easily.

However, in the case of the pressure-system purge processing, if the system is not provided with the suction pump for generating a negative pressure in the cap, there occurs a problem that the ink ejected from the head stays in the cap so that the ink cannot be discharged to the outside of the cap effectually.

As for this problem, it is not impossible to provide a suction pump even when the pressure-system purge processing is performed. Indeed, there is a solution that a suction pump is provided to eliminate the ink from the cap.

However, in such a solution, the suction pump is provided separately in addition to the pressure pump. Thus, there occurs another problem that the number of pumps increases, thereby causing disadvantages in terms of both the cost and the number of man-hours in comparison with the suction system in which ink suction and negative pressure generation in the cap can be performed with a single pump.

In addition, the inventor has examined a structure in which a cap has a large displacement between a time when the cap is in close contact with the head and a time when the cap is at a distance from the head. In this case, when the suction pump is fixed to a main body side as in the inkjet printer according to JP-A-2002-301831, it is necessary to provide a counter measure such as a sufficiently long flexible tube for connecting the cap having the large displacement and the suction pump having no displacement.

However, the longer such a flexible tube is, the lower the suction capability of the pump is. It is therefore necessary to provide a pump having higher performance, causing increase in size or cost of the pump. In addition, as the flexible tube is longer, the risk that the flexible tube moving following the cap is caught or entangled by something becomes higher. Further, when a barrier-free space for allowing the flexible tube to move smoothly is secured to prevent the flexible tube from being caught or entangled by something, the size of the printer may be increased correspondingly to the secured barrier-free space.

When, for example, a structure is adopted in which a suction pump moves retaining the position relationship with a cap, such an excessively long flexible tube is dispensed with. Accordingly, these problems may be solved.

However, for such a countermeasure, it is also necessary to secure a space for allowing the pump to move, still causing increase in the size of the printer. In addition, the movement of the pump may provoke a failure of the pump.

SUMMARY OF THE INVENTION

The present invention was developed to solve the foregoing problems. It is a first object of the invention to provide an inkjet printer in which purge processing using a pressure system is performed and in which ink ejected into a cap can be recovered easily without providing any suction pump.

It is a second object of the invention to provide an inkjet printer adopting a structure in which even if a position of a cap changes largely, ink ejected into the cap can be recovered easily without using any long flexible tube or any suction pump.

It is a third object of the invention to provide a cap unit for a maintenance unit of an inkjet printer, which has a simple configuration for closing an ink channel thereof.

According to a first aspect of the invention, an inkjet printer includes a head, a cap, a primary recovery portion, and a secondary recovery portion. The head includes an ink ejection surface that ejects ink. The cap is capable of moving to come into contact with the ink ejection surface of the head. The cap includes an ink outflow channel where the ink ejected from the head flows out to external due to weight of the ink. The primary recovery portion allows the ink flowing out from the cap through the ink outflow channel to flow into the primary recovery portion to recover the ink. The secondary recovery portion includes an ink absorber, which absorbs the ink due to a capillary phenomenon from the primary recovery portion to recover the ink.

According to a second aspect of the invention, an inkjet printer includes a line-type head, a movable body, a cap, a primary recovery portion, and a secondary recovery portion. The line-type head is fixed to a main body at a position where the head faces a transport path of a paper-like recording medium. The head includes an ink ejection surface that ejects ink. The movable body is movable forward and backward between a first position where the movable body is present in front of the ink ejection surface of the head in an ink ejection direction and a second position where the movable body is out of a front of the ink ejection surface of the head in the ink ejection direction. The cap is mounted on the movable body. The cap is capable of moving to come into contact with the ink ejection surface of the head and includes an ink out flow channel where the ink ejected from the head flows out to external due to weight of the ink. The primary recovery portion is mounted on the movable body. The primary recovery portion allows the ink flowing out from the cap through the ink outflow channel to flow into the primary recovery portion to recover the ink. The secondary recovery portion is fixed to the main body. The secondary recovery portion includes an ink absorber, which absorbs the ink due to a capillary phenomenon from the primary recovery portion to recover the ink. The primary recovery portion comes into contact with the secondary recovery portion to allow the secondary recovery portion to absorb the ink from the primary recovery portion when the movable body reaches one of the first and second positions.

According to a third aspect of the invention, a cap unit for a maintenance unit of an ink jet printer includes a cap member and a valve. The cap member includes a channel communicating one side of the cap member and another side of the cap member. The valve contacts an end portion of the channel to close the channel.

First, in the inkjet printer of the first aspect, the ink ejected from the head flows out to the external due to weight of the ink through the ink outflow channel provided in the cap. Such an ink outflow channel can be formed by setting its diameter and length to be large enough to prevent the ink from staying inside the ink outflow channel and allow the ink to flow down due to weight of the ink, in consideration of the viscosity, the surface tension and the like of the ink.

Then, the ink flowing out from the cap through the ink outflow channel flows into the primary recovery portion. The primary recovery portion is a place where the ink flowing therein from the cap is recovered temporarily. The ink absorbed into the primary recovery portion is absorbed further into the secondary recovery portion due to a capillary phenomenon.

In the inkjet printer configured thus, the ink in the cap reaches the primary recovery portion due to weight of the ink and further reaches the secondary recovery portion due to a capillary phenomenon. Accordingly, the ink in the cap can be discharged from the cap without providing any suction pump. Therefore, even when the pressure-system purge processing is adopted, the ink can be discharged from the cap without any problems, but it is not necessary to provide a suction pump separately in addition to the pressure pump. Thus, there is no disadvantage in terms of the cost or the number of man-hours, in comparison with the suction system.

In addition, since the ink is once absorbed in the primary recovery portion and then moved to the secondary recovery portion due to a capillary phenomenon, there is no problem even when the volume of the primary recovery portion is made comparatively small. Thus, the primary recovery portion can be made compact enough to be put in a limited space near the cap. On the other hand, the secondary recovery portion does not have to be always provided near the cap as long as the secondary recovery portion can absorb ink from the primary recovery portion. Thus, the secondary recovery portion may be put in an enough space at a distance from the cap. Accordingly, the space inside the printer can be used effectively.

Further, ink can be recovered temporarily by the primary recovery portion, and then the ink recovered by the primary recovery portion can be absorbed into the secondary recovery portion when the secondary recovery portion is ready to absorb the ink. Accordingly, as long as the secondary recovery portion can absorb ink before the primary recovery portion is saturated, the secondary recovery portion may have a structure in which the secondary recovery portion cannot always absorb ink.

In the ink jet printer of the second aspect, when ink is ejected from the head, the ink flows out to the external through the ink outflow channel due to weight of the ink. The ink flows into the primary recovery portion and is further absorbed by the secondary recovery portion due to a capillary phenomenon. Thus, the ink in the cap can be discharged from the cap without providing any suction pump. In addition, even when the pressure-system purge processing is adopted, the ink can be discharged from the cap without any problems, and it is not necessary to provide a suction pump separately in addition to the pressure pump. Thus, there is no disadvantage in terms of the cost or the number of man-hours, in comparison with the suction system.

In addition, since the ink once absorbed by the primary recovery portion is moved to the secondary recovery portion due to a capillary phenomenon, there is no problem even if the volume of the primary recovery portion is made comparatively small. Thus, the primary recovery portion to be mounted on the movable body can be made compact, while the secondary recovery portion is put in an enough space on the body side. Accordingly, the space inside the printer can be used effectively.

Further, due to the structure in which the primary recovery portion moves together with the cap, ink can be always absorbed by the primary recovery portion even during the movement of the cap. Accordingly, it is not necessary to connect the cap and the primary recovery portion through a long flexible tube. In addition, when the primary recovery portion reaches the first or second position, the primary recovery portion comes into contact with the secondary recovery portion so that the secondary recovery portion can absorb the ink from the primary recovery portion. It is therefore also unnecessary to connect the primary recovery portion and the secondary recovery portion through a long flexible tube. Accordingly, in spite of the structure in which the cap is displaced largely together with the movable body, it is not necessary to provide any long flexible tube, and there occurs no problem that such a flexible tube is caught or entangled with anything when the flexible tube moves. Thus, it is also unnecessary to secure a barrier-free space required for wiring such a flexible tube.

In the cap unit of the third aspect, it is sufficient for the valve to have a simple configuration in order to open and close the ink outflow channels. Therefore, the valve can switch easily between the open state in which ink is flown out from the cap and the close state in which the ink outflow channels are sealed adequately.

DETAILED DESCRIPTION OF THE PREFERRED EMBODIMENT

Next, an embodiment of the invention will be described by way of example.

Figure 1:
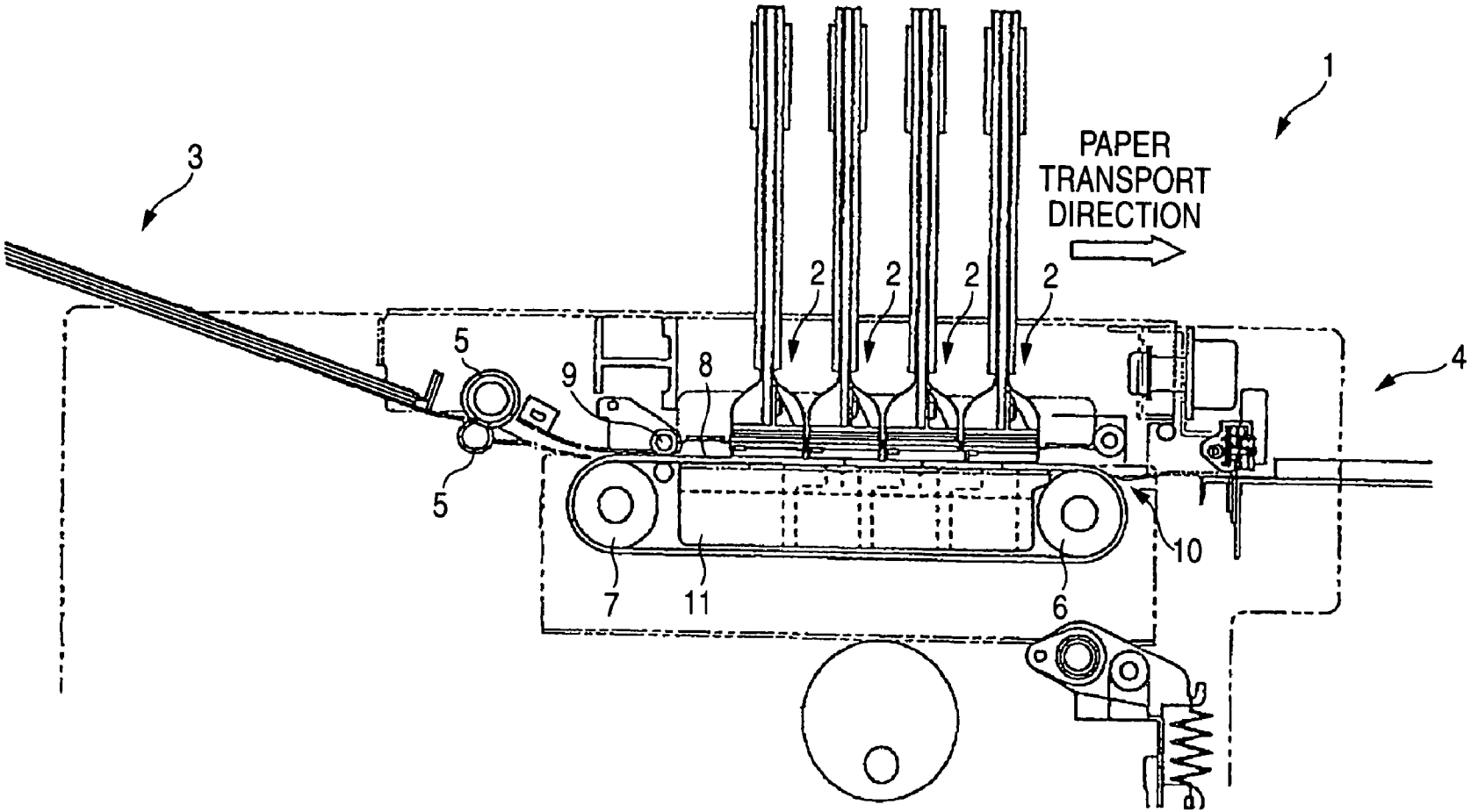
FIG. 1 is a schematic structural view of the internal structure of an inkjet printer, viewed from its left side.

FIG. 1 is a schematic structural diagram of the internal structure of an inkjet printer according to an embodiment of the invention, illustrated by way of example and viewed from its left side.

This inkjet printer 1 is a color inkjet printer, internally provided with four heads 2 corresponding to inks of four colors (magenta, yellow, cyan and black), respectively. In addition, the inkjet printer 1 is configured to transport a paper-like recording medium such as recording paper or various film (hereinafter also referred to as "paper") from a paper feed portion 3 on the back side (left in FIG. 1) to a paper discharge portion 4 on the front side (right in FIG. 1) along a paper transport path. The inkjet printer 1 is internally provided with a pair of feed rollers 5, two belt rollers 6 and 7, a transport belt 8, a presser member 9, a separation unit 10, a guide member 11, etc.

The pair of feed rollers 5 are disposed just on the downstream side of the paper feed portion 3, and pulls out paper from the paper feed portion 3 one by one. and feeds the paper downstream in the paper transport direction.

The two belt rollers 6 and 7 and the transport belt 8 laid between the belt rollers 6 and 7 are disposed on the downstream side of the feed rollers 5 (in the intermediate portion of the paper transport path). The transport belt 8 is driven by one of the belt rollers 6. The transport belt 8 uses its outer circumferential surface as a transport surface to retain thereon the paper fed by the pair of feed rollers 5 and to transport the paper to the downstream side. The outer circumferential surface of the transport belt 8 has been subjected to silicon treatment so that the paper can be retained on the outer circumferential surface by the adhesive force of the outer circumferential surface.

The presser member 9 is disposed in a position opposed to the belt roller 7 through the paper transport path. The presser member 9 presses the paper onto the transport surface of the transport belt 8 so as to make the paper adhere to the transport surface firmly enough to prevent the paper on the transport belt 8 from floating from the transport surface.

The separation unit 10 is provided on the downstream side of the transport belt 8. The separation unit 10 is a unit for separating the paper adhering to the transport surface of the transport belt 8 from the transport surface, and feeding the paper toward the paper discharge portion 4 on the downstream side.

The guide member 11 is disposed in a space on the inner circumferential side of the transport belt 8. The guide member 11 has a substantially rectangular parallelepiped shape substantially as wide as the transport belt 8. The guide member 11 is located to be just opposed to the head 2. Coming into contact with the inner circumferential surface of the transport belt 8 passing above the guide member 11, the guide member 11 supports the transport belt 8 from its inner circumferential side.

The four heads 2 are disposed in parallel in the paper transport direction. Each head 2 is formed into a long rectangular shape extending in a direction perpendicular to the paper transport direction in plan view, and provided with an ink eject portion on its lower end side. The ink eject portion of the head 2 includes a flow channel unit in which an ink flow channel including a pressure chamber is formed, and an actuator for applying pressure to ink in the pressure chamber. The flow channel unit and the actuator are glued with each other so as to eject ink onto the paper passing under the ink eject portion through small-diameter eject nozzles formed in the bottom surface of the ink eject portion. Each head 2 is a line-type head in which a number of eject nozzles required for forming a line of an image extending in a direction perpendicular to the paper transport direction are formed into a predetermined array. The head 2 configured thus is disposed to form a slight space between the lower surface of the head 2 and the transport surface of the transport belt 8. Thus, the paper transported on the transport belt 8 passes just under the ink eject portions of the four heads 2 in turn, and inks of respective colors are ejected from the eject nozzles toward the upper surface (printing surface) of the paper. In such a manner, a desired color image can be formed.

Figure 2:
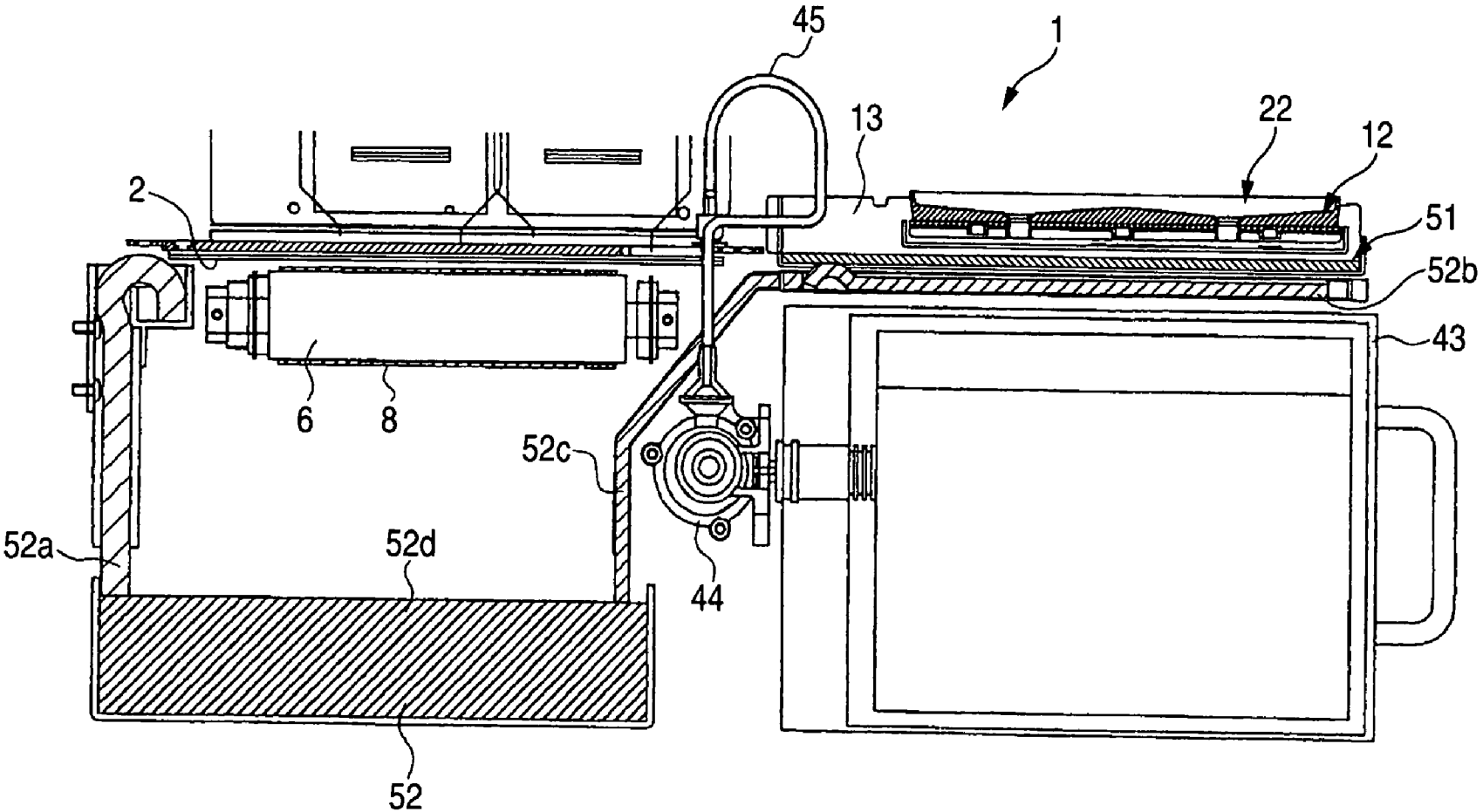
FIG. 2 is a schematic structural front view of the internal structure of the inkjet printer in which a maintenance unit is in a retraction position.
Figure 3:
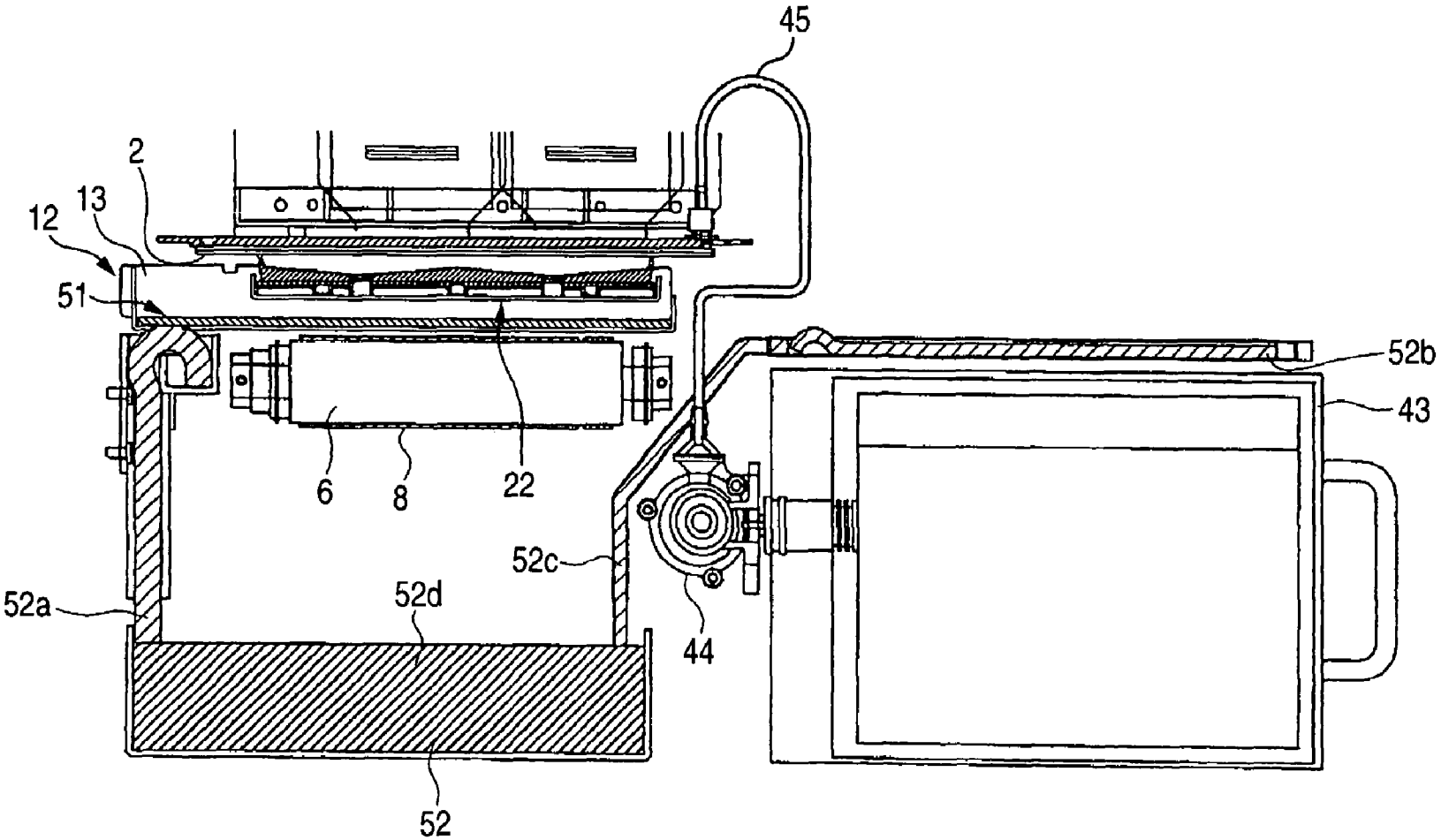
FIG. 3 is a schematic structural front view of the internal structure of the inkjet printer in which the maintenance unit is in a maintenance position.

FIGS. 2 and 3 are schematic structural front views of the internal structure of the inkjet printer 1. The heads 2, the belt roller 6, the transport belt 8, and so on, described above, are disposed on the left side with respect to the center in FIGS. 2 and 3.

Each head 2 has a structure in which the head 2 is movable in directions perpendicular to a surface of the paper (up/down directions). The head 2 is configured as follows. That is, at the time of printing, the head 2 driven by a not-shown motor to move to a descent position (see FIG. 2) where the head 2 approaches the upper surface of the transport belt 8. At the time of non-printing, the head 2 driven by the motor to move to an ascent position (see FIG. 3) where the head 2 has a more distance from the upper surface of the transport belt 8 than at the time of printing, and expands the hap between the head 2 and the transport belt 8.

In addition, a maintenance unit 12 is disposed in the gap between the head 2 and the transport belt 8, which is formed when the head 2 is displaced to the ascent position.

Figure 4:
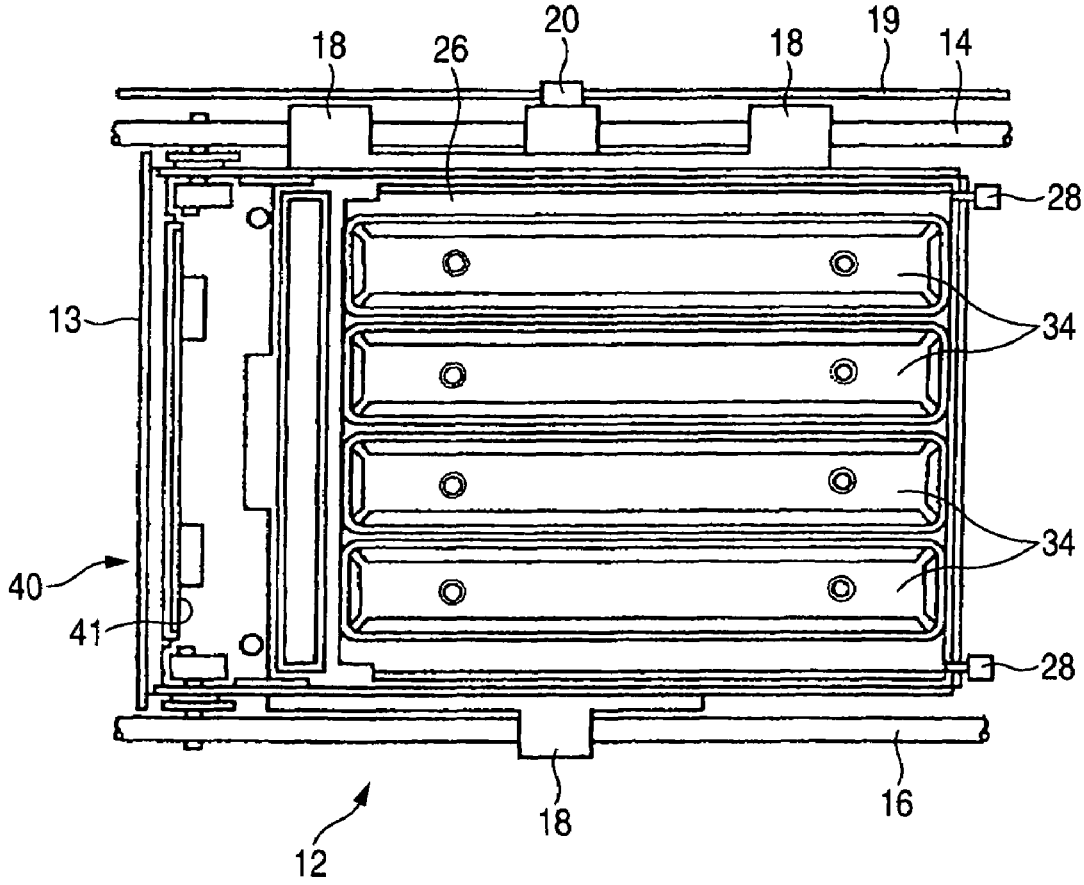
FIG. 4 is a schematic structural plan view of the maintenance unit.

FIG. 4 is a schematic structural plan view of the maintenance unit 12.

The maintenance unit 12 has a movable body 13 movable in the direction (left/right direction), which is perpendicular to the paper transport direction (front/rear direction) and is perpendicular to the moving direction (up/down direction) of the head 2.

The movable body 13 is supported slidably on two guide bars 14 and 16 through a plurality of sliding members 18 as shown in FIG. 4. The guide bars 14 and 16 extend horizontally in a direction perpendicular to the paper transport direction. In addition, a timing belt 19 is laid in parallel to the guide bars 14 and 16. The movable body 13 and the timing belt 19 are coupled with each other through a coupling member 20. When the timing belt 19 is actuated by a not-shown motor, the movable body 13 is moved along the guide bars 14 and 16 so that the movable body 13 moves to a first position (see FIG. 3) where the movable body 13 is present in the ink ejection direction with respect to the head 2, or a second position (see FIG. 2) where the movable body 13 is not present in the ink ejection direction with respect to the head 2. Incidentally, in the following description, the position of the maintenance unit 12 when the movable body 13 moves to the first position will be referred to as "maintenance position", and the position of the maintenance unit 12 when the movable body 13 moves to the second position will be referred to as "retraction position".

Figure 5:
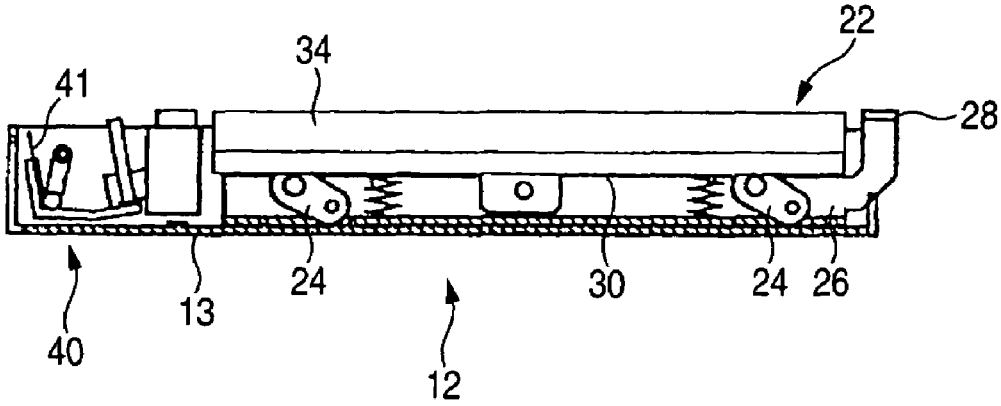
FIG. 5 is a schematic structural front view of the maintenance unit which has moved to the retraction position.
Figure 6:
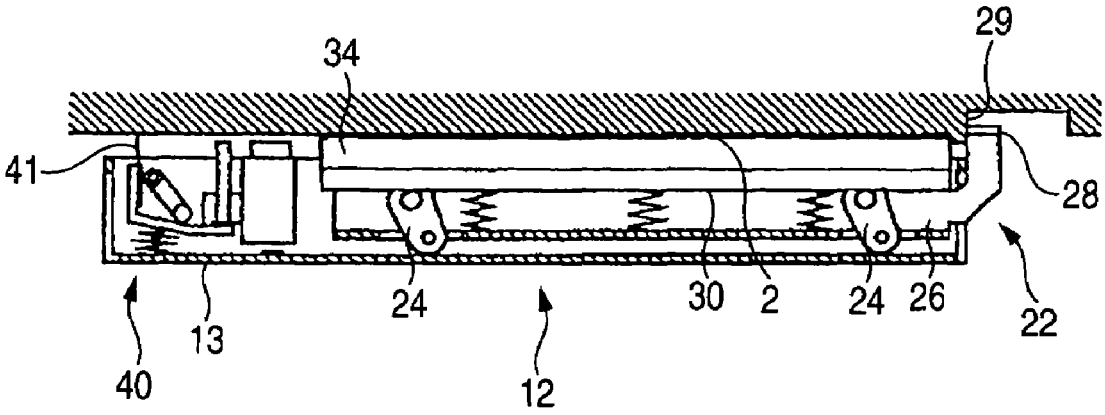
FIG. 6 is a schematic structural front view of the maintenance unit which has moved to the maintenance position.

FIGS. 5 and 6 are schematic structural front views of the maintenance unit 12. FIG. 5 shows a state where the maintenance unit 12 has moved to the retraction position. FIG. 6 shows a state where the maintenance unit 12 has moved to the maintenance position.

The maintenance unit 12 has a structure where a cap unit 22 is mounted on the top side of the movable body 13, as shown in FIGS. 5 and 6.

The cap unit 22 is attached to the movable body 13 through a plurality of links 24. In particular, the cap unit 22 has a structure as follows. That is, a maintenance holder 26 is provided in a lower portion of the cap unit 22, and one end of each link 24 is coupled rotatably with the movable body 13 while the other end of the link 24 is coupled rotatably with the maintenance holder 26. Due to such a coupling structure, the cap unit 22 can move obliquely upward (right obliquely upward in FIG. 5) relatively to the movable body 13 around one end of each link 24 in an arc while retaining the parallel position relationship between the maintenance holder 26 and the movable body 13.

When the maintenance unit 12 is located at the retraction position, the cap unit 22 moves down, due to weight of the ink, to the position where the cap unit 22 comes into contact with the upper surface side of the movable body 13 (see FIG. 5). On the other hand, when the maintenance unit 12 moves to the maintenance position so that each lever 28 provided to project over the maintenance holder 26 abuts against each abutment portion 29 on a main body side of the inkjet printer 1, the cap unit 22 moves obliquely upward relatively to the movable body 13 as described above, due to the force of the abutment portion 29 acting on the cap unit 22 (see FIG. 6). Incidentally, the cap unit 22 moves obliquely upward in an arc relatively to the movable body 13 as described above. However, due to the abutment of the lever 28 against the abutment portion 29, the cap unit 22 is not displaced horizontally relatively to the abutment portion 29. Therefore, the cap unit 22 is displaced vertically with respect to the main body of the inkjet printer 1, so as to move upward straightly toward the ink ejection surface of the head 2 just above the cap unit 22 in FIG. 6 and come into contact with the ink ejection surface.

In this embodiment, a mechanical structure including the links 24 and the lever 28 is adopted to move the cap unit 22 upward. Since the mechanical structure includes no driving device, e.g. a motor, the mechanical structure has advantages in the size and the cost.

Figure 7A:
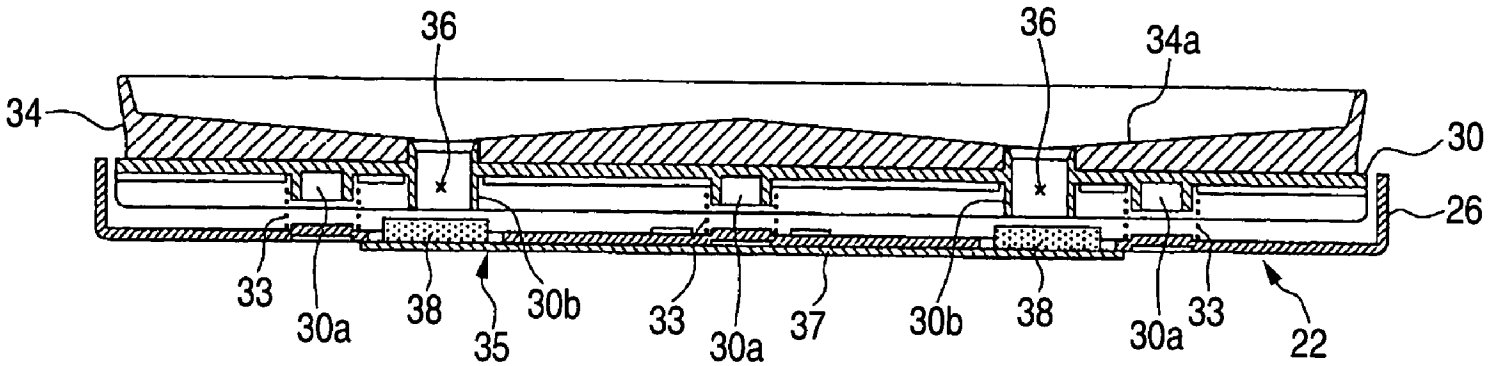
FIGS. 7A and 7B are detailed structural front views of a cap unit.
Figure 7B:
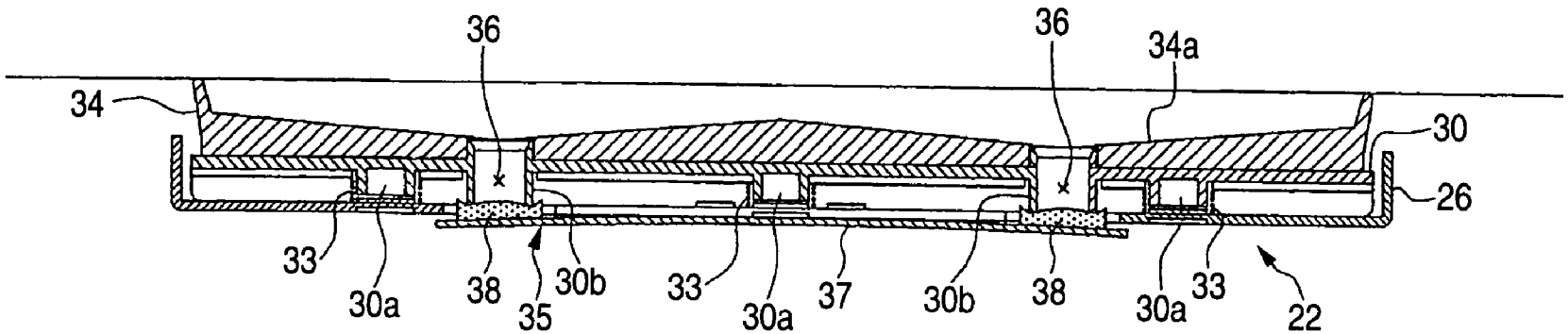

FIGS. 7A and 7B are more detailed structural front views of the cap unit 22. FIG. 7A shows the state where the maintenance unit 12 is located at the retraction position. FIG. 7B shows the state where the maintenance unit 12 is located at the maintenance position.

The cap unit 22 is provided with a structure including a cap holder 30, compression springs 33, a cap 34, a valve 35 and so on as well as the maintenance holder 26.

The cap holder 30 is attached to the upper surface side of the maintenance holder 26 so as to be movable in the up/down direction relatively to the maintenance holder 26. Three shafts 30*a* are provided to project from the lower surface side of the cap holder 30. The compression springs 33 are fitted to the outer circumferences of the shafts 30*a*, respectively. The compression springs 33 are interposed between the maintenance holder 26 and the cap holder 30 so as to apply an urging force to thereby expand the distance between the maintenance holder 26 and the cap holder 30. A plurality of lock pieces (not shown) extending downward are formed on the cap holder 30. When the distance between the maintenance holder 26 and the cap holder 30 is expanded, those lock pieces are hung on the maintenance holder 26 so as to prevent the distance between the maintenance holder 26 and the cap holder 30 from being expanded to be larger than a predetermined distance. Thus, the compression springs 33 are always compressed somewhat. In addition, two cylindrical portions 30*b* are provided to project from the cap holder 30.

The cap 34 is formed out of a material having rubber elasticity, particularly formed out of a material resistant against ink (such as butyl rubber or EPDM). The cap 34 is mounted on the upper surface side of the cap holder 30 so as to move up/down together with the cap holder 30. The upper end of the cap 34 is formed into a shape, which will surround all of a large number of nozzles formed in the ink ejection surface of the head 2 when the cap 34 is brought into close contact with the ink ejection surface of the head 2. A recess portion 34*a* dished downward is formed on the upper surface side of the cap 34. Through holes penetrating the cap 34 in the up/down direction are formed at two places, which are the deepest in the recess portion 34*a*, respectively. The upper ends of the cylindrical portions 30*b* are inserted into the through holes of the cap 34 respectively. Thus, each of lumens of the cylindrical portions 30*b* defines each of ink outflow channels 36 for allowing ink to flow out from the inside of the cap 34 to the outside due to weight of the ink. Incidentally, four caps 34 are provided correspondingly to the four heads 2 as shown in FIG. 4.

The valve 35 includes a plate spring (elastic body) 37 and rubber plates (elastically deformable sealing bodies) 38. The plate spring 37 is fixed at its longitudinally central portion to the lower surface of the maintenance holder 26 so that the end portions of the plate spring 37 can be deformed elastically. The rubber plates 38 are fixedly attached to the upper surface of the plate spring 37 at its longitudinally opposite end portions respectively. Holes one size larger than the rubber plates 38 are formed in the maintenance holder 26. The rubber plates 38 are put into the holes. Thus, the rubber plates 38 are positioned to be opposed to the lower ends of the cylindrical portions 30*b*, respectively.

Incidentally, a wiping mechanism 40 is also mounted on the maintenance unit 12 as shown in FIGS. 5 and 6. The wiping mechanism 40 is a mechanism for moving a wiper blade 41 up and down so as to wipe the ink ejection surface of the head 2 with the wiper blade 41. When the maintenance unit 12 moves from the retraction position to the maintenance position, the wiper blade 41 is moved upward. When the maintenance unit 12 moves from the maintenance position to the retraction position again, the ink ejection surface of the head 2 can be wiped with the wiper blade 41.

Further, the inkjet printer 1 has ink supply mechanisms each including an exchangeable ink cartridge 43, an ink supply pump 44 and an ink supply tube 45. The ink supply mechanism is configured to supply ink from the ink cartridge 43 to the head 2 through the ink supply pump 44 and the ink supply tube 45. Four sets of such ink supply mechanisms are provided correspondingly to the number of heads 2 in order to supply different color inks to the four heads 2.

The ink supply pump 44 is actuated to supply ink to the head 2 for the first time after the exchange of the ink cartridge 43. Thus, the ink supply channel from the ink cartridge 43 to the head 2 can be filled with the ink. In addition, the ink supply pump 44 is also actuated to perform purge processing for eliminating high-concentration ink staying in the nozzles of the head 2. Ink is transmitted to the head 2 under pressure so as to eject the high-concentration ink from the nozzles of the head 2. Thus, the performance of the head 2 can be recovered.

In addition, the inkjet printer 1 has a primary recovery portion 51 and a secondary recovery portion 52 as an ink recovery mechanism. The primary recovery portion 51 is mounted on the movable body 13, and the secondary recovery portion 52 is provided on the main body side of the inkjet printer 1.

The primary recovery portion 51 is constituted by an ink absorber made from a porous material, nonwoven fabric, or the like, capable of absorbing ink due to a capillary phenomenon. Ink flowing out from the cap 34 flows into the primary recovery portion 51 through the ink outflow channels 36 (see FIGS. 7A and 7B). Thus, the ink is absorbed into the primary recovery portion 51 temporarily. The primary recovery portion 51 has a lower profile than any part of the secondary recovery portion 52. Thus, the volume of the primary recovery portion 51 capable of absorbing ink is smaller than that of the secondary recovery portion 52 in accordance with the size difference.

The secondary recovery portion 52 includes ink absorbers 52*a* to 52*d* made of a porous material, nonwoven fabric, or the like, capable of absorbing ink due to a capillary phenomenon in the same manner as the primary recovery portion 51. The ink absorber 52*a* is disposed at a position where the primary recovery portion 51 will come into contact with the ink absorber 52*a* when the maintenance unit 12 moves to the maintenance position (see FIG. 3). The ink absorber 52*a* can absorb ink from the primary recovery portion 51 when the primary recovery portion 51 is in contact with the ink absorber 52*a*. The ink absorber 52*b* is disposed at a position where the primary recovery portion 51 will come into contact with the ink absorber 52*b* when the maintenance unit 12 moves to the retraction position (see FIG. 2). The ink absorber 52*b* can absorb ink from the primary recovery portion 51 when the primary recovery portion 51 is in contact with the ink absorber 52*b*. The ink absorber 52*c* is disposed at a position where the ink absorber 52*b* is always in contact with the ink absorber 52*c*, so that the ink absorber 52*c* can absorb ink from the ink absorber 52*b*. The ink absorber 52*d* is an ink absorber having the largest volume. The ink absorber 52*d* is disposed at a position where the ink absorbers 52*a* and 52*c* are always in contact with the ink absorber 52*d*, so that the ink absorber 52*d* can absorb ink from the ink absorbers 52*a* and 52*c*.

At a place where the primary recovery portion 51 and the secondary recovery portion 52 are in contact with each other or at a place where the ink absorbers 52*a*-52*d* of the secondary recovery portion 52 are in contact with each other, ink migrates in accordance with a difference in volume of absorbed ink, that is, from an ink absorber having a larger volume of absorbed ink to an ink absorber having a smaller volume of absorbed ink. In addition, affected by gravitation, ink is easy to migrate to an ink absorber at a lower position. Thus, when a certain quantity or more of ink has been absorbed, the ink finally migrates to the ink absorber 52*d*, which is disposed at the lowest position.

In the inkjet printer 1 configured thus, at the time of non-printing (for example, before turning on of power), the head 2 moves up and the maintenance unit 12 is located at the maintenance position, as shown in FIG. 3.

Here, in order to understand the state where the maintenance unit 12 is located at the maintenance position, it is important to know the motion of each part of the maintenance unit 12 when the maintenance unit 12 moves from the retraction position to the maintenance position.

When the maintenance unit 12 moves from the retraction position toward the maintenance position, each lever 28 abuts against each abutment portion 29 when the movable body 13 reaches the vicinity of the maintenance position. Then, when the movably body 13 moves further toward the maintenance position while retaining the abutment between the lever 28 and the abutment portion 29, the cap unit 22 moves up toward the head 2 with the rotations of the links 24. Incidentally, the wiping mechanism 40 also operates in this event, so as to move the wiper blade 41 to a position where the wiper blade 41 abuts against the ink ejection surface of the head 2.

Before the maintenance unit 12 moves to the maintenance position (that is, when the maintenance unit 12 is located at the retraction position), the cap unit 22 is located at a position where the cap unit 22 has moved down relatively to the movable body 13, and the cap 34 has been separated from the ink ejection surface of the head 2. Therefore, the pressure force of the compression springs 33 has pushes the cap holder 30 and the cap 34 so as to displace the cap holder 30 and the cap 34 to a position where the cap holder 30 and the cap 34 have moved up relatively to the maintenance holder 26 (see FIG. 7A). In this event, the lower ends of the cylindrical portions 30*b* on the lower surface side of the cap holder 30 have been separated from the upper surfaces of the rubber plates 38 of the valve 35, so that the valve 35 has opened the ink outflow channels 36.

In this state, when the maintenance unit 12 moves to the maintenance position and then the cap unit 22 moves up relatively to the movable body 13, the cap holder 30 and the cap 34 move up together with the maintenance holder 26. However, the cap holder 30 and the cap 34 cannot move up any more when the upper end of the cap 34 is brought into abutment and close contact with the ink ejection surface of the head 2. As a result, only the maintenance holder 26 moves up further relatively to the movable body 13. Thus, the compression springs 33 are compressed between the maintenance holder 26 and the cap holder 30 so that the maintenance holder 26 is displaced to narrow the distance between the cap holder 30 and the maintenance holder 26 (see FIG. 7B). In this event, the lower ends of the cylindrical portions 30*b* on the lower surface side of the cap holder 30 are pressed onto the upper surfaces of the rubber plates 38 of the valve, 35 respectively. Thus, the rubber plates 38 are displaced downward to increase bending of the plate spring 37. As a result, the rubber plates 38 are brought into pressure contact with the lower ends of the cylindrical portions 30*b*, respectively by the force of the plate spring 37. Thus, the valve 35 closes the ink outflow channels 36.

Each part on the maintenance unit 12 operates in such a manner. Thus, at the time of nonprinting when the maintenance unit 12 is located at the maintenance position, the cap 34 is in close contact with the head 2, and the valve 35 closes the ink outflow channels 36. Accordingly, at the time of nonprinting, the inside of the cap 34 is blocked from the atmosphere so that ink can be prevented from evaporating from the nozzles of the head 2.

On the other hand, when printing is started, purge processing is first performed to recover the nozzles of the head 2 from clogging or the like. When the purge processing is performed, the ink supply pump 44 is actuated to send ink from the ink cartridge 43 to the head 2 under pressure. Thus, the ink is ejected from the nozzles of the head 2. The ejected ink stays in the cap 34, but the volume thereof is set to be smaller than the volume of the cap 34.

After that, the maintenance unit 12 moves to the retraction position as shown in FIG. 2. In this event, the maintenance unit 12 moves toward the retraction position while the wiper blade 41 is wiping the ink ejection surface of the head 2. In addition, when the maintenance unit 12 moves to the retraction position so that the cap 34 leaves the head 2, the valve 35 opens the ink outflow channels 36. Thus, the ink staying in the cap 34 flows down through the ink outflow channels 36 due to weight of the ink. The ink flowing out the ink outflow channels 36 flows down the through holes formed in the bottom portion of the maintenance holder 26 of the cap unit 22. Then, the ink is absorbed into the primary recovery portion 51 provided on the upper surface side of the movable body 13.

The primary recovery portion 51 comes into contact with the ink absorber 52*a* of the secondary recovery portion 52 when the maintenance unit 12 moves to the maintenance position (see FIG. 3). The primary recovery portion 51 also comes into contact with the ink absorber 52*b* of the secondary recovery portion 52 when the maintenance unit 12 moves to the retraction position (see FIG. 2). That is, the primary recovery portion 51 and the secondary recovery portion 52 come into contact with each other when the maintenance unit 12 reaches each of the rest positions at the opposite ends. In this state, the ink absorbed in the primary recovery portion 51 is further absorbed into the secondary recovery portion 52. Thus, the ink absorbing ability of the primary recovery portion 51 is restored. Then, the ink absorbed by the ink absorbers 52*a* and 52*b* are finally absorbed into the ink absorber 52*d*.

Incidentally, after the maintenance unit 12 moves to the retraction position, the head 2 moves down. Printing is performed in this state. Further, after the printing is terminated, the head 2 moves up again while the maintenance unit 12 moves to the maintenance position, as shown in FIG. 3. After becoming this state, the power is turned off.

In the inkjet printer 1 configured thus, the ink in the cap 34 reaches the primary recovery portion 51 due to weight of the ink, and further reaches the secondary recovery portion 52 due to a capillary phenomenon. Accordingly, the ink in the cap 34 can be discharged to the outside of the cap 34 without providing any suction pump. Thus, in the inkjet printer 1, the ink can be discharged to the outside of the cap 34 with no problem in spite of the pressure-system purge processing adopted therein.

In addition, in the inkjet printer 1, the ink once absorbed in the primary recovery portion 51 including a low-profile ink absorber is moved to the large-volume secondary recovery portion 52 due to a capillary phenomenon. Accordingly, the primary recovery portion 51 can be put compactly into a limited space near the cap 34 while the secondary recovery portion is put into an enough space at a distance from the cap 34. Thus, the space inside the printer can be used effectively.

In addition, the inkjet printer 1 has a structure in which the primary recovery portion 51 moves together with the cap 34. Accordingly, the primary recovery portion 51 can always absorb ink even during the movement of the cap 34. It is therefore unnecessary to connect the cap 34 and the primary recovery portion 51 through a long flexible tube. In addition, when the movable body 13 reaches the first or second position, the primary recovery portion 51 comes into contact with the secondary recovery portion 52 so that the ink in the primary recovery portion 51 is made absorbable into the secondary recovery portion 52. Thus, it is also unnecessary to connect the primary recovery portion 51 and the secondary recovery portion 52 through a long flexible tube. Accordingly, even if the structure in which the cap 34 is displaced largely together with the movable body 13 is adopted, it is unnecessary to provide any long flexible tube, and there occurs no problem that such a flexible tube is caught or entangled with anything when the flexible tube moves. Thus, it is also unnecessary to secure a barrier-free space required for wiring such a flexible tube.

The secondary recovery portion 52 does not require a movable structure in which the secondary recovery portion 52 is movable following the moving direction of the primary recovery portion 51. Thus, there occurs no needless trouble such as a failure in operation. Further, the configuration that only the primary recovery portion 51 moves while the primary recovery portion 51 is always in contact with the secondary recovery portion 52 is not adopted. Thus, the abrasion in the contact surface between the primary recovery portion 51 and the secondary recovery portion 52 can be suppressed.

Further, in the inkjet printer 1, the primary recovery portion 51 is brought into contact with the secondary recovery portion 52 in each of the rest positions at the opposite ends in the moving direction in which the primary recovery portion 51 moves forward and backward. Accordingly, ink can be recovered into the secondary recovery portion 52 efficiently in comparison with a case where such a rest position is set at only one of the opposite ends.

Furthermore, in the inkjet printer 1, an ink absorber capable of absorbing ink due to a capillary phenomenon is provided also in the primary recovery portion 51. Accordingly, there occurs no trouble that ink spills out due to the vibration of the primary recovery portion 51 caused by the movement of the movable body 13.

In addition, in the inkjet printer 1, the valve 35 closes the ink outflow channels 36 when the cap 34 is in close contact with the head 2. Accordingly, there is no fear that the atmosphere is introduced into the cap 34 through the ink outflow channels 36. Thus, the effect of retaining the moist condition of the head 2 is enhanced so that the ink in the nozzles can be prevented from increasing in concentration.

Also, in the ink jet printer 1, the valve 35 of the simple configuration can open and close the ink outflow channels 36. Therefore, the valve 35 can switch easily between the open state in which ink is flown out from the cap 34 and the close state in which the ink outflow channels 36 are sealed adequately.

Incidentally, in the case where such a valve 35 is provided, when the cap 34 is brought into close contact with the head 2 for performing purge processing, the valve 35 closes the ink outflow channel 36 so that the ink stays in the cap 34 or the ink outflow channel 36. Routinely, it is therefore preferable to separate the cap 34 from the head 2 to thereby open the valve 35 at least once, and then close the valve 35 after the ink flows out through the ink outflow channel 36. For example, when printing operation is performed at least once after the purge processing, the cap 34 can be separated from the head 2 to thereby open the valve 35. Thus, it is sufficient to perform the printing operation.

However, differently from a long flexible tube needing a pump, the ink outflow channel 36 is formed to allow ink to flow down due to weight of the ink, so that there is no fear that the ink outflow channel 36 is clogged with the ink even if the concentration of the ink increases somewhat. Accordingly, there is no special problem even if a small quantity of ink is left in the cap 34 or the ink outflow channel 36 when the valve 35 is closed. Thus, there is no problem even if the valve 35 is left closed with ink staying due to power off or the like.

It can be expected, if anything, that a small quantity of ink staying may enhance the effect of keeping the head moist. Accordingly, to enhance the effect of keeping the head moist, the valve 35 may be closed in the state in which a certain quantity of ink stays in the ink outflow channel 36, or a small quantity of ink may be ejected from the head 2 after the valve 35 is closed. In such a manner, a small quantity of ink may be left in the cap 34 or the ink outflow channel 36 on purpose.

Although the embodiment of the invention has been described above, the invention is not limited to the specific embodiment, but the invention can be carried out in various modes other than the embodiment. Description will be made below on useful modifications.

In the aforementioned embodiment, the ink absorber of the primary recovery portion 51 and the ink absorber 52*a* or 52*b* of the secondary recovery portion 52 are disposed so that the both are brought into pressure contact with each other simply by the displacement of the movable body 13 to the first or second position. However, there may be provided a pressing mechanism for displacing a part of the secondary recovery portion 52 interlocking with the motion of the primary recovery portion 51 to press the secondary recovery portion 52 onto the primary recovery portion 51 when the primary recovery portion 51 reaches the rest position.

Figure 8B:
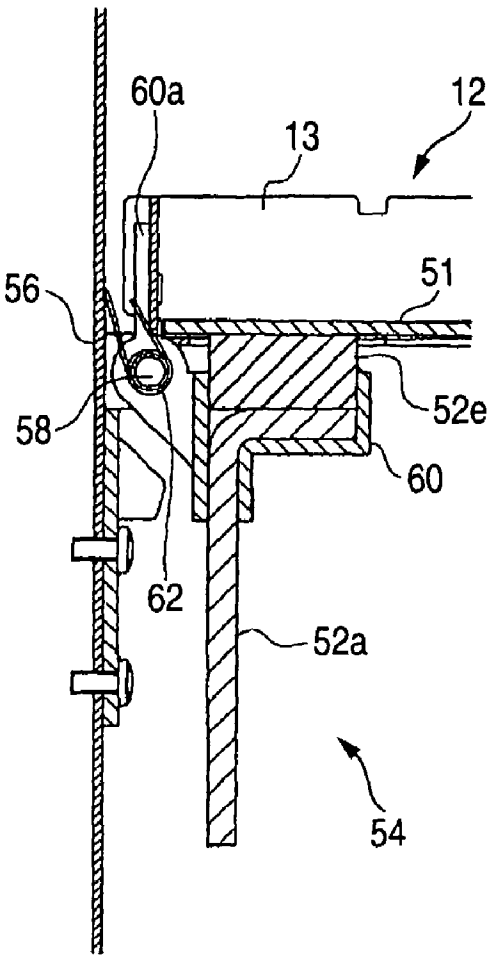
FIGS. 8A and 8B are explanatory views showing the state where a pressing mechanism is actuated.

More detailed description will be given below. For example, a pressing mechanism 54 as shown in FIGS. 8A and 8B may be adopted in the inkjet printer 1.

The pressing mechanism 54 is a mechanism for pressing an ink absorber 52*e*, which is a part of the secondary recovery portion 52, onto the primary recovery portion 51 when the maintenance unit 12 moves to the maintenance position. The pressing mechanism 54 has a rotary member 60 and a torsion spring 62. The rotary member 60 can rotate around a spindle 58 fixed to a frame 56. The torsion spring 62 urges the rotary member 60 to rotate clockwise in FIGS. 8A and 8B.

Figure 8A:
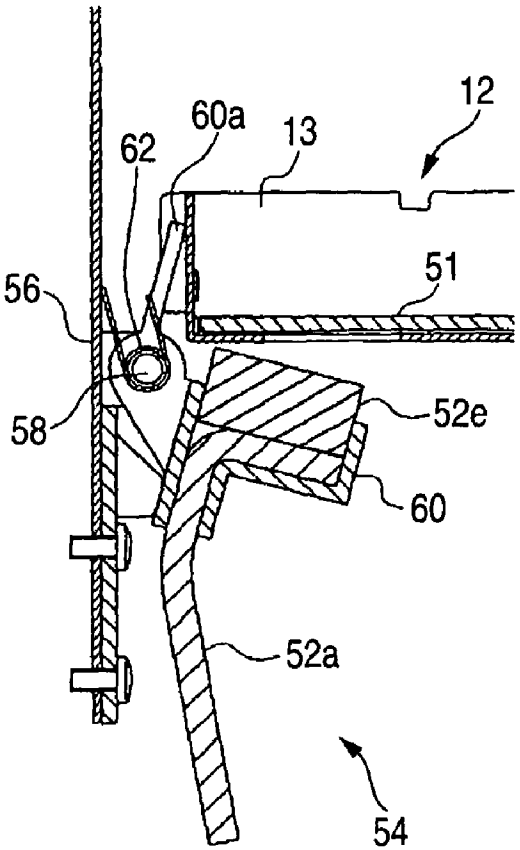

Till the maintenance unit 12 reaches the maintenance position, the torsion spring 62 urges the rotary member 60 to thereby displace the rotary member 60 to the position shown in FIG. 8A. When the maintenance unit 12 approaches the maintenance position, a side surface of the maintenance unit 12 comes into contact with a lever 60*a* of the rotary member 60. Under such a condition, the maintenance unit 12 reaches the maintenance position while pushing the lever 60*a*. In this event, the rotary member 60 including the lever 60*a* pushed rotates counterclockwise in FIGS. 8A and 8B, so as to be displaced to the position shown in FIG. 8B. In accordance with the displacement, the ink absorber 52*e* retained by the rotary member 60 is displaced upward and pressed onto the primary recovery portion 51. Incidentally, the rotary member 60 also retains the ink absorber 52*a*. The ink absorbed in the ink absorber 52*e* is absorbed further into the ink absorber 52*a*. Thus, the ink is recovered into the secondary recovery portion 52.

Figure 9A:
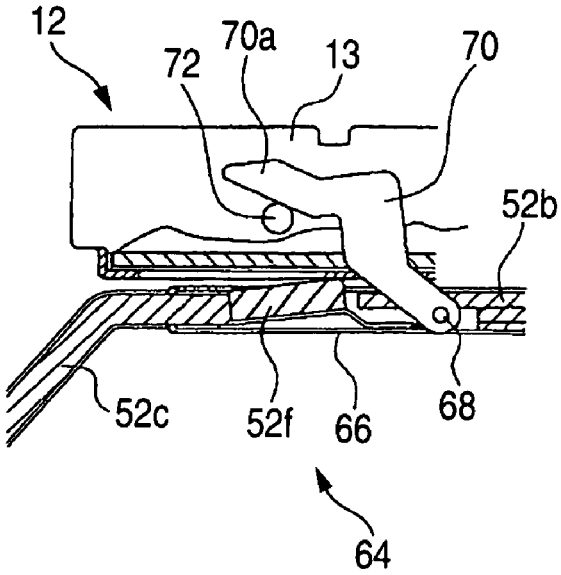
FIGS. 9A and 9B are explanatory views showing the state where another pressing mechanism is actuated.
Figure 9B:
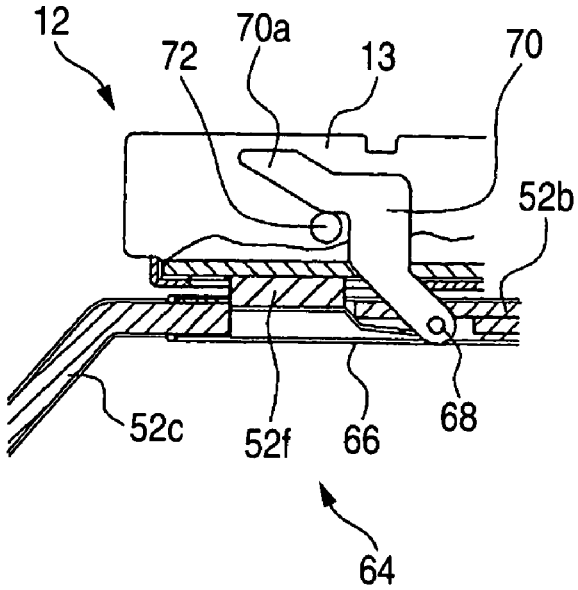

In addition, for example, a pressing mechanism 64 as shown in FIGS. 9A and 9B may be adopted in the inkjet printer 1.

The pressing mechanism 64 is a mechanism for pressing an ink absorber 52*f*, which is a part of the secondary recovery portion 52, onto the primary recovery portion 51 when the maintenance unit 12 moves to the retraction position. The pressing mechanism 64 includes a rotary member 70 which can rotate around a spindle 68 fixed to a frame 66.

Till the maintenance unit 12 reaches the retraction position, the rotary member 70 rotates due to weight of the ink based on a relationship between a spindle 68 as the center of rotation and the center of gravity, so as to be displaced to the position shown in FIG. 9A. When the maintenance unit 12 approaches the retraction position, a pin 72 provided to project on a side surface of the maintenance unit 12 abuts against a lever 70*a* of the rotary member 70. Under such a condition, the maintenance unit 12 reaches the retraction position while pushing up the lever 70*a*. In this event, the rotary member 70 including the lever 70*a* pushed up rotates clockwise in FIGS. 9A and 9B, so as to be displaced to the position shown in FIG. 9B. In accordance with the displacement, the ink absorber 52*f* retained by the rotary member 70 is displaced upward and pressed onto the primary recovery portion 51. Incidentally, the ink absorbers 52*b* and 52*c* which are other parts of the secondary recovery portion 52 are also retained on the frame 66 so as to slide-contact with the ink absorber 52*f*. Therefore, the ink absorbed in the ink absorber 52*f* is absorbed further into the ink absorbers 52*b* and 52*c*. Thus, the ink is recovered into the secondary recovery portion 52.

When the pressing mechanism 54 or 64 as described above is provided, a part of the secondary recovery portion 52 is displaced interlocking with the motion of the primary recovery portion 51 so that the secondary recovery portion 52 is pressed onto the primary recovery portion 51. Thus, the close contact performance between the primary recovery portion 51 and the secondary recovery portion 52 is enhanced so that ink can be recovered into the secondary recovery portion 52 efficiently.

Incidentally, not to say, it is preferable to provide both the pressing mechanisms 54 and 64. However, a reasonable effect can be achieved even when only one of them is provided.

In terms of enhancement in the close contact performance between the primary recovery portion 51 and the secondary recovery portion 52, it is preferable to provide the pressing mechanism 54, 64 in each of the rest positions. However, if one of the pressing mechanisms 54, 64 is omitted, the structure can be made compact correspondingly to the omitted one. Thus, it is also of use to provide the pressing mechanism 54, 64 in only one of the rest positions where importance should be attached to the close contact performance while omitting the pressing mechanism 54, 64 in the other where importance should be attached to the compactness.

When the secondary recovery portion 52 has a single ink absorber, a part of the single ink absorber corresponds to the part of the secondary recovery portion 52 to be displaced by the pressing mechanism 54, 64. On the other hand, when the secondary recovery portion 52 has a plurality of ink absorbers adapted so that ink absorbed by one of the ink absorbers is absorbed by another ink absorber in turn, a part or all of one of the ink absorbers corresponds to the part of the secondary recovery portion 52 to be displaced by the pressing mechanism 54, 64.

Next, the embodiment has shown the case where the ink outflow channels 36 are closed by the valve 35 when the cap 34 is in close contact with the head 2. However, the atmosphere maybe prevented from flowing back into the ink outflow channels 36 by use of another means.

More detailed description will be given below. An ink reservoir 74 or 76, for example, as shown in FIGS. 10A to 10D may be adopted in the inkjet printer 1.

The ink reservoir 74 is provided in place of the rubber plate 38 of the valve 35. The ink reservoir 76 is formed as a recess portion deeper than the ink reservoir 74, by perforating the plate spring 37.

Figure 10A:
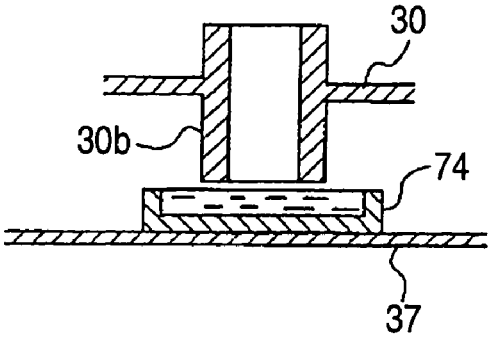
FIGS. 10A to 10D are structural views showing ink reservoirs.
Figure 10B:
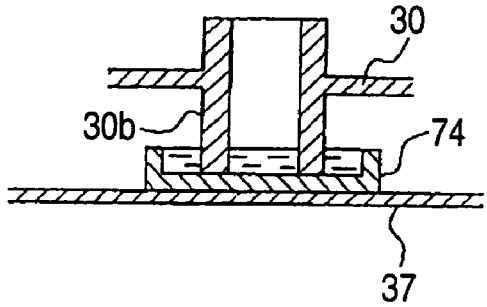
Figure 10C:
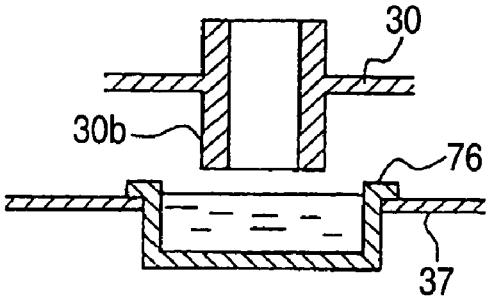
Figure 10D:
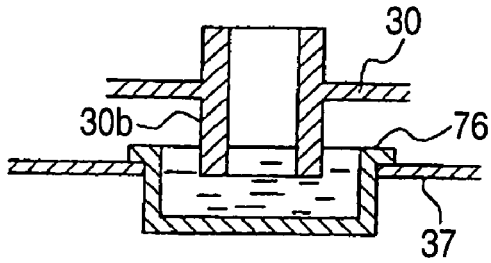

With the movement of the maintenance holder 26, the lower end of each cylindrical portion 30*b* formed in the cap holder 30 is made to separate from the ink in the ink reservoir 74, 76 (see FIGS. 10A, 10C) or to sink in the ink in the ink reservoir 74, 76 (see FIGS. 10B, 10D). When the lower end of the cylindrical portion 30*b* has sunk in the ink, the air flow is blocked by the ink. Therefore, the air-tightness is retained without bringing the ink reservoir 74 into strong pressure contact with the lower end of the cylindrical portion 30*b*. Thus, the atmosphere can be prevented from flowing back into the ink outflow channel 36.

Incidentally, as shown in FIG. 10D, the lower end of the cylindrical portion 30*b* may always sink in the ink so long as it is not in contact with the bottom of the ink reservoir 76. That is, if ink flows into the cylindrical portion 30*b* from above, a part of the ink will stay in the ink reservoir 76 while the rest overflows downstream from the ink reservoir 76. Thus, since the air flowing back through the ink outflow channel 36 can be blocked by the ink staying in the ink reservoir 76, it is not always necessary to displace the cylindrical portion 30*b* to the position shown in FIG. 10C. Such a structure has a function just the same as a drain trap to be provided in a drain pipe. In other words, an ink reservoir formed to have a structure similar to a known drain trap can block the atmosphere flowing back through the ink outflow channel 36 while allowing ink to flow out therethrough.

In FIGS. 10C and 10D, the ink reservoir 76 is provided on the plate spring 37 expediently in order to clarify the relationship to the aforementioned embodiment. However, in the structure where the lower end of the cylindrical portion 30*b* is not in contact with the bottom of the ink reservoir 76, the cylindrical portion 30*b* applies no pressing force to the plate spring 37. Thus, the ink reservoir 76 may be provided not on the plate spring 37 but on a member whose rigidity is too high to be elastically deformed.

In addition, the air-tightness is always retained due to the ink reservoir 74, 76. Accordingly, there is no fear that the atmosphere is introduced into the cap 34 through the ink outflow channel 36. Thus, the effect of keeping the head 2 moist is enhanced so that the ink in the nozzles can be prevented from increasing in concentration.

As for the specific shape of the ink reservoir 74, 76, a structure similar to one adopted as a drain trap of a drain pipe can be adopted desirably. For example, a structure similar to an S-shaped pipe, a U-shaped pipe, a P-shaped pipe, a drain trap called a dish type or a bell type may be provided. That is, since such a drain trap blocks odors etc. flowing back through a drain pipe while allowing water to flow out therethrough, the ink reservoir 74, 76 uses a mechanism similar to the drain trap to block the atmosphere flowing back through the ink outflow channel 36 while allowing ink to flow out therethrough.

Incidentally, both the ink reservoir 74, 76 and the valve 35 are countermeasures for preventing the atmosphere from being introduced into the cap 34 through the ink outflow channel 36. Therefore, one of those countermeasures may be adopted to make the structure simpler. However, structurally, it is possible to adopt both the ink reservoir 74, 76 and the valve 35. Therefore, both the means may be adopted to attach importance to the effect of keeping the head 2 moist.

The aforementioned embodiment shows a case where the primary recovery portion 51 comes into contact with the secondary recovery portion 52 so as to allow the secondary recovery portion 52 to absorb ink from the primary recovery portion 51 when the primary recovery portion 51 reaches a rest position where it stops moving. The invention is not limited to this embodiment, but may be applied to, for example, a structure where the primary recovery portion 51 is in contact with the primary recovery portion 52 even during the movement of the primary recovery portion 51. In this case, however, the sliding surface between the primary recovery portion 51 and the secondary recovery portion 52 is abraded easily. Thus, it is desired to adopt a structure in which such abrasion can be suppressed.

Figure 11A:
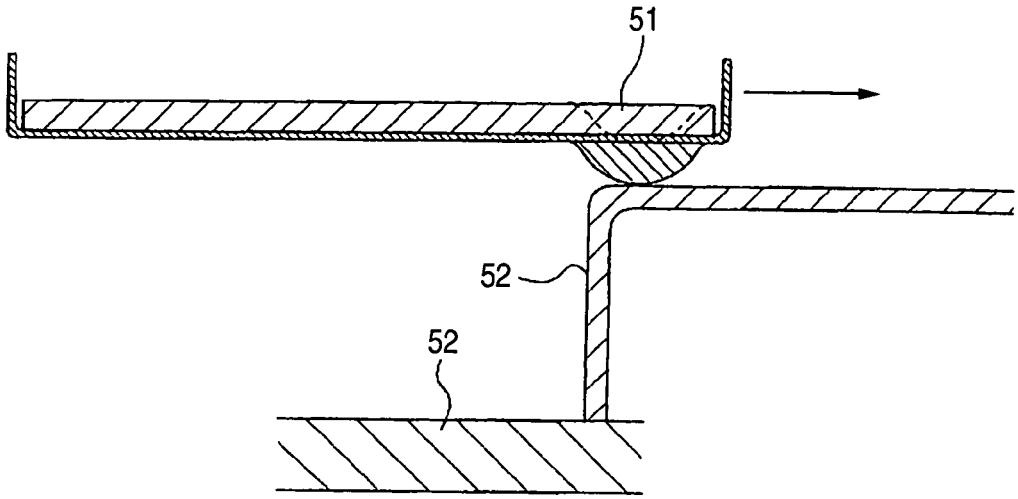
FIGS. 11A to 11C are explanatory views showing modifications as to the state where a primary recovery portion and a secondary recovery portion are in contact with each other.
Figure 11B:
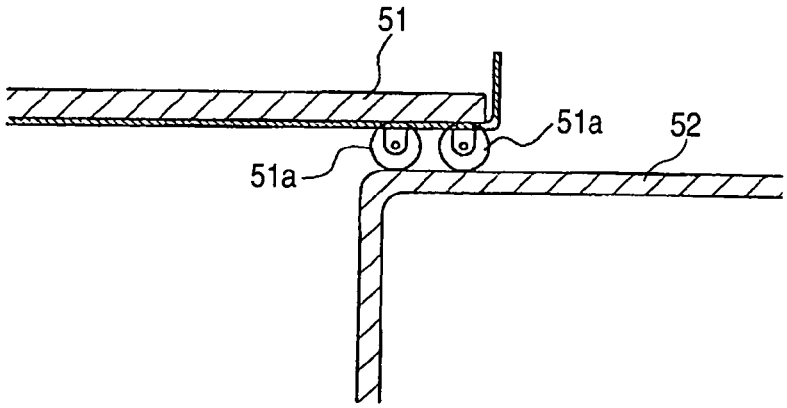
Figure 11C:
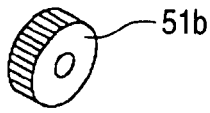

An example of such a structure capable of suppressing abrasion may include a structure in which rollers 51*a* made of hard felt are provided as parts of the primary recovery portion 51, for example, as shown in FIG. 11B. When such a structure is adopted, ink is absorbed into the secondary recovery portion 52 through the rollers 51*a* while the abrasion occurring between the primary recovery portion 51 and the secondary recovery portion 52 is suppressed because the rollers 51*a* roll on the secondary recovery portion 52 during the movement of the primary recovery portion 51.

Alternatively, rollers 51*b* made of resin and having a large number of grooves cut in its circumference may be provided in stead of the rollers 51*a* made of hard felt. The rollers 51*b* receive ink from the primary recovery portion 51 into the grooves or scrape ink from the primary recovery portion 51 through the grooves, and migrate the ink retained in the grooves to the secondary recovery portion 52. Even when such a structure is adopted, ink is absorbed into the secondary recovery portion 52 through the rollers 51*b* while the abrasion occurring between the primary recovery portion 51 and the secondary recovery portion 52 is suppressed because the rollers 51*b* roll on the secondary recovery portion 52 during the movement of the primary recovery portion 51.

Although the primary recovery portion 51 including an ink absorber is provided on the movable body 13 in the aforementioned embodiment, the primary recovery portion may be arranged without using any ink absorber. For example, an ink reservoir similar to that shown in FIGS. 10A-10D may be provided under the cap unit 22. In this case, the secondary recovery portion 52 is adapted to enter the ink reservoir whenever the maintenance unit 12 is disposed in any one of the maintenance position and the retraction position.

Further, although the inkjet printer 1 illustrated in the aforementioned embodiment is a line printer having line-type heads 2, the configuration according to the invention is also applicable to a serial printer performing printing while moving heads forward/backward in an direction perpendicular to the paper transport direction.

What is claimed is:

1. An inkjet printer comprising:

a head including an ink ejection surface that ejects ink;

a cap capable of moving to come into contact with the ink ejection surface of the head, the cap includes an ink outflow channel where the ink ejected from the head flows out to external due to weight of the ink;

a primary recovery portion that allows the ink flowing out from the cap through the ink outflow channel to flow into the primary recovery portion to recover the ink, the primary recovery portion being configured to move together with the cap; and a secondary recovery portion including an ink absorber, which draws and absorbs the ink due to a capillary phenomenon from the primary recovery portion by contacting the ink absorber to the primary recovery portion to recover the ink, wherein the primary recovery portion is movable between a position where the primary recovery portion contacts the ink absorber and a position where the primary recovery position is separated from the ink absorber.

2. The inkjet printer according to claim 1, wherein the primary recovery portion includes an ink absorber that absorbs the ink due to the capillary phenomenon.

3. The inkjet printer according to claim 1, further comprising:

a valve that closes the ink outflow channel when the cap is in close contact with the head and opens the ink outflow channel when the cap is at a distance from the head.

4. The inkjet printer according to claim 1, further comprising:

an ink reservoir disposed in the middle of the ink outflow channel, the ink reservoir that reserves a part of the ink flowing into the ink reservoir from an upstream and allows a remainder of the ink to overflow to a downstream, to make the reserved ink block gas flowing back through the ink outflow channel.

5. The inkjet printer according to claim 1, further comprising:

an ink reservoir disposed at an outlet of the ink outflow channel, the ink reservoir that reserves a part of the ink flowing into the ink reservoir from an upstream and allows a remainder of the ink to overflow to a downstream, to make the reserved ink block gas flowing back through the ink outflow channel.

6. The ink jet printer according to claim 1, wherein:

the cap moves between a first position and a second position; and when the cap reaches the first position, the cap is in close contact with the head.

7. An inkjet printer comprising:

a head including an ink ejection surface that ejects ink;

a cap capable of moving to come into contact with the ink ejection surface of the head, the cap includes an ink outflow channel where the ink ejected from the head flows out to external due to weight of the ink;

a primary recovery portion that allows the ink flowing out from the cap through the ink outflow channel to flow into the primary recovery portion to recover the ink, the primary recovery portion being configured to move together with the cap; and a secondary recovery portion including an ink absorber, which draws and absorbs the ink due to a capillary phenomenon from the primary recovery portion by contacting the ink absorber to the primary recovery portion to recover the ink, wherein the primary recovery portion moves together with the cap in a direction perpendicular to a direction in which the cap moves to come into contact with the ink ejection surface; and the primary recovery portion comes into contact with the secondary recovery portion to allow the secondary recovery portion to absorb the ink from the primary recovery portion when the primary recovery portion reaches a rest position where the primary recovery portion stops moving.

8. The inkjet printer according to claim 7, wherein:

the primary recovery portion moves forward and backward between two positions;

the rest position is located in each of both ends in a moving direction of the primary recovery portion; and the primary recovery portion comes into contact with the secondary recovery portion when the primary recovery portion reaches the rest position in each of both ends.

9. The inkjet printer according to claim 7, further comprising:

a pressing mechanism that displaces a part of the secondary recovery portion interlocking with the motion of the primary recovery portion to press the secondary recovery portion onto the primary recovery portion when the primary recovery portion reaches the rest position.

* * * * *